US007208689B2

(12) United States Patent
Kodoh

(10) Patent No.: US 7,208,689 B2
(45) Date of Patent: Apr. 24, 2007

(54) SWITCH

(75) Inventor: Eiji Kodoh, Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/476,671

(22) Filed: Jun. 29, 2006

(65) Prior Publication Data

US 2007/0007117 A1 Jan. 11, 2007

(30) Foreign Application Priority Data

Jul. 6, 2005 (JP) ..... 2005-197145

(51) Int. Cl.
*H01H 9/00* (2006.01)

(52) U.S. Cl. ..... 200/293; 200/341

(58) Field of Classification Search ..... 200/520, 200/341, 293, 303, 307, 329, 406, 517, 516, 200/16 D, 16 DA
See application file for complete search history.

(56) References Cited

U.S. PATENT DOCUMENTS

| | | | | |
|---|---|---|---|---|
| 4,675,486 | A * | 6/1987 | Niinuma | 200/276.1 |
| 5,459,292 | A * | 10/1995 | Nagano et al. | 200/5 R |
| 6,770,829 | B1 * | 8/2004 | Hart | 200/314 |
| 6,781,071 | B2 * | 8/2004 | Leng et al. | 200/61.54 |
| 6,815,628 | B2 * | 11/2004 | Okita et al. | 200/406 |
| 6,998,554 | B2 * | 2/2006 | Shimoda et al. | 200/341 |

FOREIGN PATENT DOCUMENTS

JP 2004-273199 9/2004

* cited by examiner

*Primary Examiner*—Michael A. Friedhofer
(74) *Attorney, Agent, or Firm*—Wenderoth, Lind & Ponack, L.L.P.

(57) ABSTRACT

A switch including at least one boss, outwardly protruding from the side surface(s) of the case, located below the supports which extend downward so as to engage the side surfaces of the case. Thus, if the switches occasionally collide with each other, with tools, the like the boss prevents the supports of the cover from receiving an outward force and thereby prevent the cover from coming off from the case.

8 Claims, 5 Drawing Sheets

SWITCH

BACKGROUND OF THE INVENTION

1. Field of the Invention

The present invention relates to a switch used to operate electronic equipment.

2. Description of Related Art

With recent advances in the compact and low-profile design of various kinds of electronic equipment such as the TV set, video recorder, air conditioner or the like, the switch used for the equipment is also required to be compact, low-profile, and reliable.

Such a conventional switch is described with reference to FIGS. 4 and 5. FIG. 4 shows a perspective view of the conventional switch and FIG. 5 shows a cross-sectional view of the same. In FIGS. 4 and 5, generally box shaped case 1 is formed from an insulation resin and is open-topped. Fixed contact 2 is formed from a conductive thin metal plate. A plurality of fixed contacts 2 are securely implanted on internal surfaces of case 1, with terminal pins 2A protruding downward from the bottom surface of case 1.

Operating body 3 is formed from an insulation resin and is housed in case 1 and is vertically moveable. Head 3A protruding upward is formed on top of operating body 3.

Movable contact 4, which is formed of an elastic thin metal plate bent into an open sided square, is mounted on operating body 3. Movable contact 4 touches fixed contact 2 elastically to form a switch assembly.

Cover 5 is formed from an insulation resin and spring 6 has a coiled form. Cover 5 covers an opening in the top surface of case 1 and spring 6 is mounted between the bottom end of operating body 3 and the internal bottom surface of case 1 while being compressed slightly. Spring 6 biases operating body 3 with head 3A protruding upward out of the opening in the top surface of case 1.

Cover 5 is provided with a pair of supports 5A extending downward. Land 1A disposed on a side surface of case 1 catches groove 5B of support 5A to fix cover 5 on case 1.

A certain number of switches thus formed are stored or transported in packed in a bag and then head 3A is provided with a push-button before the switch is built into an operation panel of electronic equipment. Terminal pin 2A of fixed contact 2 is connected electrically to a circuit of electronic equipment by soldering or the like.

When head 3A provided with push-button or the like is pressed in the above configuration, operating body 3 moves downward while compressing spring 6. With the movement, fixed contacts 2 to which movable contact 4 touches elastically are switched over, performing an electrical switching.

When head 3A is released from the pressing force, operating body 3 returns upward to the original position by the restoring force of spring 6.

Japanese Patent Unexamined Publication No. 2004-273199 is known as an example of the above-described conventional switch.

However, when stored, packed in bags and transported, or built into equipment, the aforementioned conventional switches have collided with each other or with tools or the like, occasionally hitting support 5A of cover 5. Upon such an outward force being applied to support 5A, groove 5B would come off from land 1A provided on the side surface of case 1, causing problems such as breakdown or unreliable operation of the switch.

BRIEF SUMMARY OF THE INVENTION

The present invention aims at providing a switch capable of reliable operation with a simple structure to solve the conventional problems. The switch disclosed in the present invention comprises bosses protruding outward located below the supports extending downward to catch the side surfaces of the case. Even if the switches occasionally collide with each other, with tools, or the like, the bosses prevent the supports of the cover from receiving an outward force causing the cover to come off from the case. This configuration also provides a switch that is operationally reliable.

The boss can protrude farther outward than the support. This arrangement will more reliably prevent the cover from coming off of the case.

DETAILED DESCRIPTION OF THE INVENTION

The preferred embodiment of this invention is described with reference to FIGS. 1 to 3. The configurations described in the conventional art have the same reference marks as the present invention, and the detailed description thereof is omitted.

Preferred Embodiment

Figure 1:
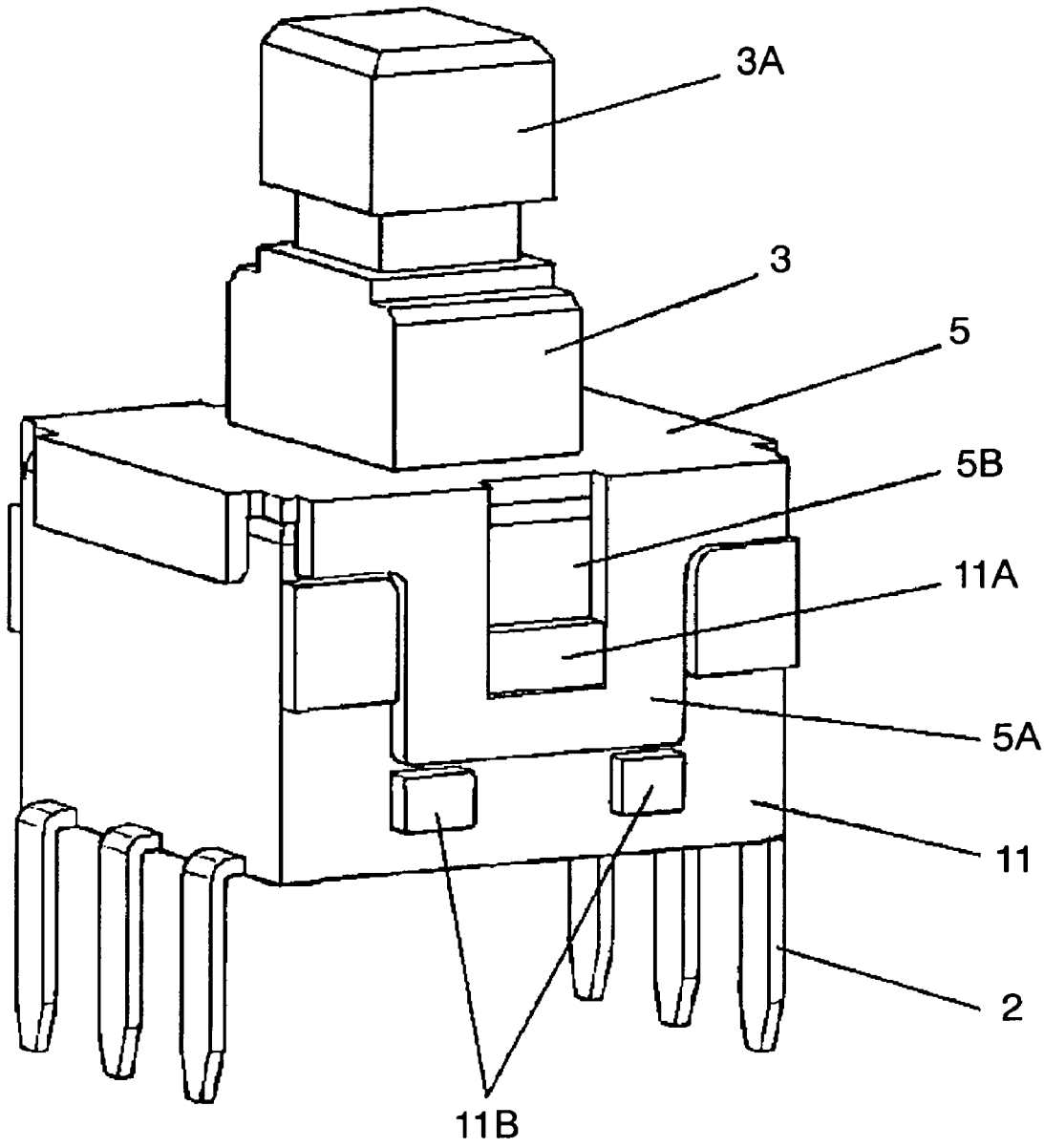
FIG. 1 shows a perspective view of a switch used in the preferred embodiment of the present invention.
Figure 2:
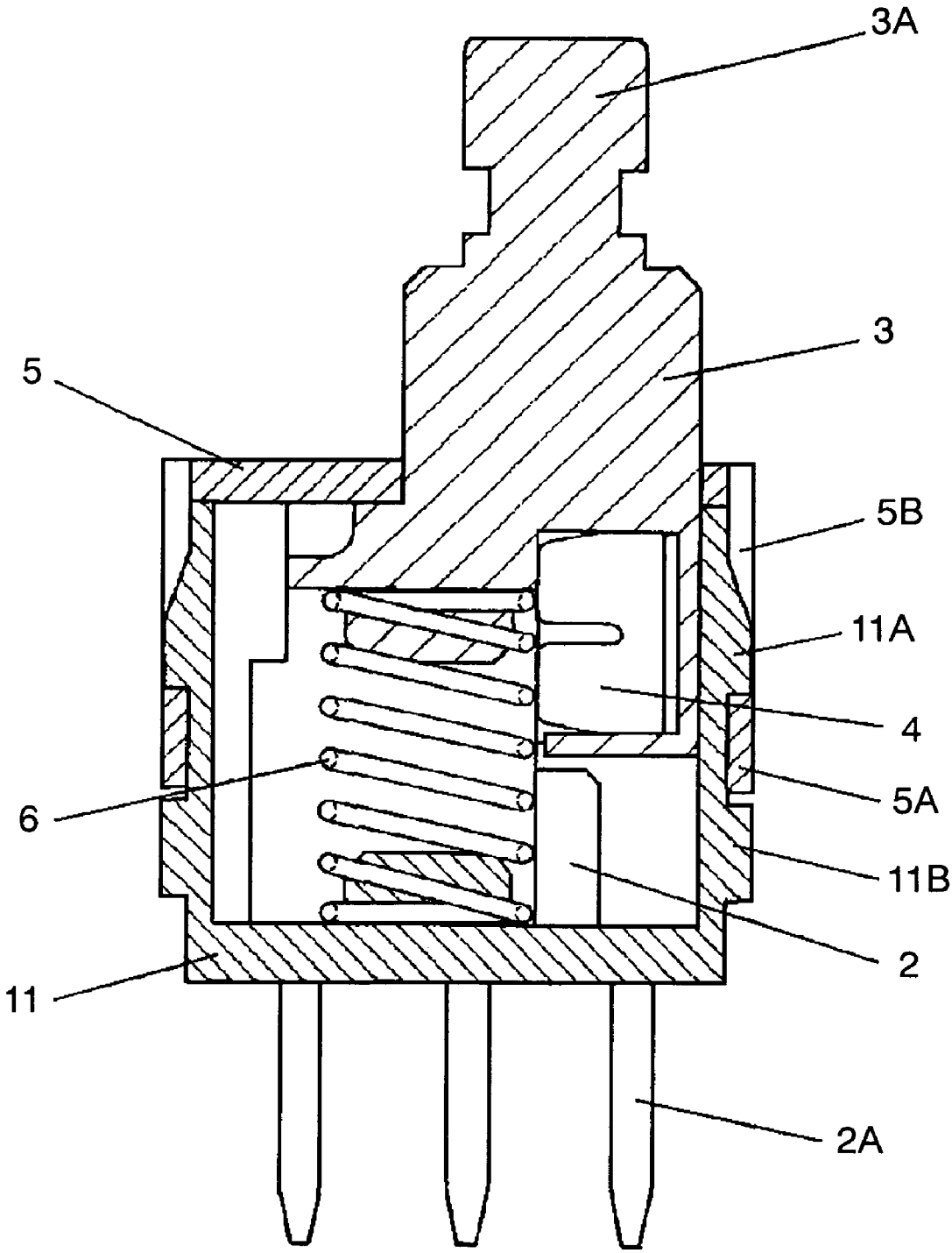
FIG. 2 shows a cross-sectional view of the switch used in the preferred embodiment of the present invention.

FIG. 1 shows a perspective view of the switch used in the preferred embodiment of the present invention, and FIG. 2 shows a cross-sectional view of the same. In FIGS. 1 and 2, open-topped box shaped case 11 is formed from an insulation resin such as polyphenylene sulfide, polybutylene terephthalate, or the like. Fixed contact 2 is formed of thin conductive metal plate such as copper alloy or the like.

A plurality of fixed contacts 2 are implanted secured on internal surface of case 11, with terminal pins 2A protruding downward from the bottom surface of case 11.

Operating body 3 is formed from an insulation resin such as polyoxymethylene, polybutylene terephthalate, or the like, is housed in case 11, and is moveable in a direction transverse to the bottom surface of case 11. Head 3A is formed so as to upwardly protrude from the top of operating body 3.

Movable contact 4 is formed from an elastic thin metal plate such as copper alloy that is bent into an open-sided-square and is mounted on operating body 3. Movable contact 4 touches fixed contact 2 elastically to form a switch assembly.

Cover 5 is formed from an insulation resin such as polyoxymethylene, and spring 6 has a coiled form. Cover 5 covers the opening in top surface of case 11 and spring 6 is mounted between the bottom end of operating body 3 and the bottom of internal surface of case 11 being compressed slightly. Spring 6 biases operating body 3 with head 3A upwardly protruding out of the opening in the top surface of case 11. Cover 5 is provided with a pair of supports 5A extending downward. Lands 11A on both sides of case 11 catch grooves (cut-outs) 5B of supports 5A to fix cover 5 on case 11. A plurality of bosses 11B are formed on both sides of case 11 below support 5A.

A certain number of switches thus formed are stored, or packed in bags and transported wherein head 3A of the switch is provided with a push-button before the switch is built into an operation panel of electronic equipment. Terminal pin 2A of fixed contact 2 is connected to a circuit of electronic equipment electrically by soldering or the like.

The structure of the switch disclosed in the present invention is such that upon being stored, packed in bags and transported, or built into equipment the cover 5 will remain secure. For example, even if the switches collide with each other, with tools, or the like, the bottom edge (leading edge) of support 5A of cover 5 will remain protected from contact because of the arrangement of the bosses 11B formed on side surfaces of case 11.

That is, the configuration is such that if the switches collide with each other, with tools, or the like the bosses 11B will receive contact, and thus no force acts on supports 5A thereby preventing supports 5A from opening outward and eventually causing grooves 5B to come off from lands 11A provided on the side surfaces of case 11. Accordingly, this configuration will prevent the breakdown or unreliable operation of the switch.

When pressing the push-button or the like on head 3A in the configuration, operating body 3 moves downward while compressing spring 6. The operation switches over fixed contact 2 to which movable contact 4 touches elastically, thus performing an electrical switching operation. When head 3A is released from the pressing force, operating body 3 returns upward to the original position by the restoring force of spring 6.

As described above in the preferred embodiment, bosses 11B are formed outwardly on both side surfaces of case 11 below supports 5A which extend downward from cover 5 to catch side surfaces of case 11. Bosses 11B prevent supports 5A of cover 5 from receiving outward forces if the switches collide with each other, with tools, or the like. The present invention, therefore, provides a switch in which the cover 5 is prevented from coming off from the case 11 so as to achieve reliable operation of the switch. Moreover, boss 11B, which protrudes outward farther than support 5A, prevents cover 5 from coming off of case 11.

Figure 3:
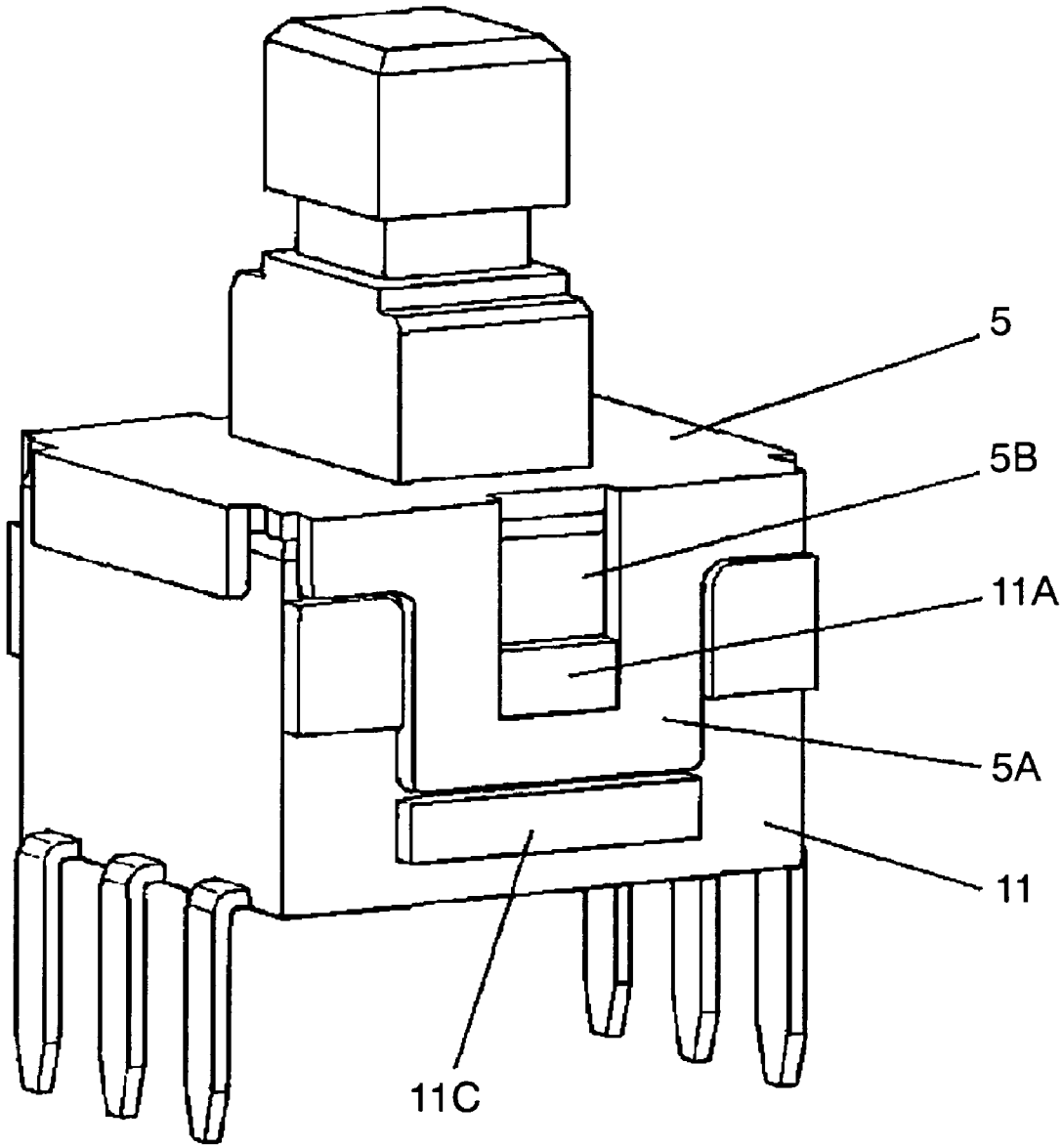
FIG. 3 shows a perspective view of another embodiment of the switch of the present invention.
Figure 4:
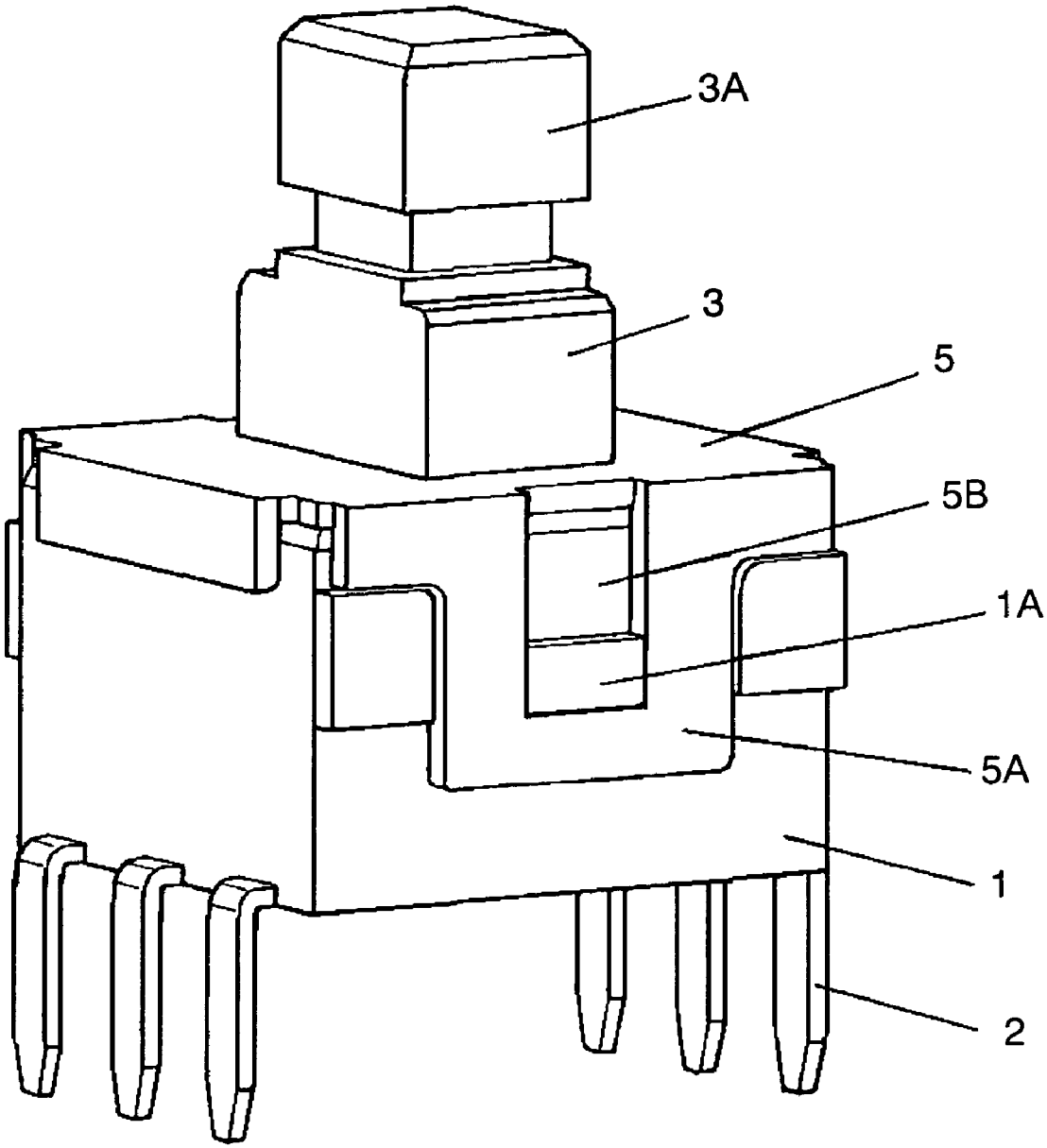
FIG. 4 PRIOR ART
FIG. 4 shows a perspective view of a conventional switch.
Figure 5:
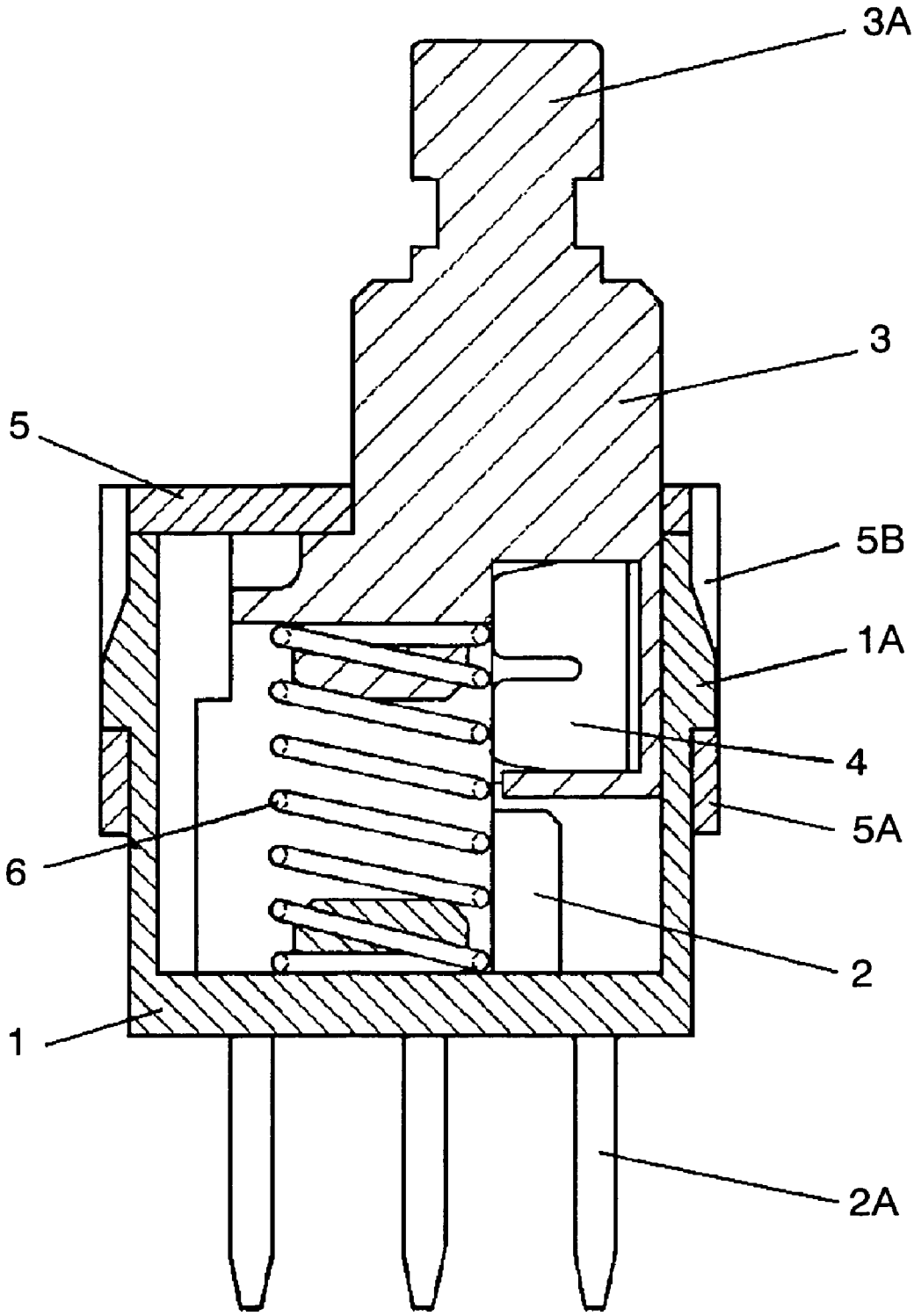
FIG. 5 PRIOR ART
FIG. 5 shows a cross-sectional view of the conventional switch.

FIG. 3 shows a perspective view of the other switch model used in the preferred embodiment of the present invention. In FIG. 3, boss 11C formed along the entire width of the bottom edge of support 5A would prevent cover 5 from coming off.

The so-called push-button switch is used as an example in the above description that operates by pressing operating body 3 which is housed in case 11 and is biased to move in a direction transverse to the bottom surface of case 11 by spring 6. However, the embodiment of the present invention can be available in other kinds of switches of different operating types such as a slide-switch, a seesaw-switch, or the like.

The present invention provides a reliable switch having a simple structure. The switch can be used in various kinds of electronic equipment.

What is claimed is:

1. A switch comprising:

a box-shaped case having a first open end, a second end, a plurality of side surfaces extending between the first open end and the second end, and a land arranged so as to outwardly protrude from one of the side surfaces;

an operating body movably supported within the box-shaped case;

a switch assembly for electrically switching according to a movement of the operating body;

a cover disposed on the first open end of the box-shaped case, the cover including at least one support extending along the side surface having the land, the support having a cut-out in which the land is received, the support extending in a direction toward the second end of the box-shaped case; and a boss arranged to outwardly protrude from the side surface having the land, wherein the boss is disposed between a leading edge of the support and the second end of the box-shaped case.

2. The switch of claim 1, wherein the boss outwardly protrudes farther than an outward protrusion of the support in relation to the side surface of the box-shaped case having the land.

3. The switch of claim 1, wherein the boss is formed to outwardly protrude as one continuous protrusion from the side surface of the box-shaped case.

4. The switch of claim 1, wherein the boss is formed to outwardly protrude as two separate protrusions from the side surface of the box-shaped case.

5. A switch comprising:

a box-shaped case having a first open end, a second end, a plurality of side surfaces extending between the first open end and the second end, a first land arranged so as to outwardly protrude from a first side surface, and a second land arranged so as to outwardly protrude from a second side surface;

an operating body movably supported within the box-shaped case;

a switch assembly for electrically switching according to a movement of the operating body;

a cover disposed on the first open end of the box-shaped case, the cover including a first support having a cut-out in which the first land is received and a second support having a cut-out in which the second land is received, each of the first and second supports extending in a direction toward the second end of the box-shaped case;

a first boss arranged to outwardly protrude from the first side surface and disposed on a portion of the first side surface which is between a leading edge of the first support and the second end of the box-shaped case; and a second boss arranged to outwardly protrude from the second side surface and disposed on a portion of the second side surface which is between a leading edge of the second support and the second end of the box-shaped case.

6. The switch of claim 5, wherein the first and second boss outwardly protrude farther than an outward protrusion of each respective first and second support in relation to each respective first and second side surface of the box-shaped case.

7. The switch of claim 5, wherein the first and second boss are formed so as to outwardly protrude as one continuous protrusion from each respective first and second side surface of the box-shaped case.

8. The switch of claim 5, wherein the first and second boss are formed to outwardly protrude as two separate protrusions from each respective first and second side surface of the box-shaped case.

* * * * *